US005401178A

United States Patent [19]

Liu

[11] Patent Number: 5,401,178

[45] Date of Patent: Mar. 28, 1995

[54] INTEGRATED FOLDABLE ELECTRIC PLUG CONNECTOR

[75] Inventor: Shane Liu, Hsing-Chung, Taiwan, Prov. of China

[73] Assignee: Delta Electronics, Inc., Taipei, Taiwan, Prov. of China

[21] Appl. No.: 117,248

[22] Filed: Sep. 3, 1993

[51] Int. Cl.[6] ..... H01R 13/44

[52] U.S. Cl. ..... 439/131

[58] Field of Search ..... 439/131, 170, 171, 172, 439/174, 221

[56] References Cited

U.S. PATENT DOCUMENTS

| | | | |
|---|---|---|---|
| 1,386,884 | 8/1921 | McKay | 439/131 |
| 3,027,507 | 3/1993 | Hubner | 439/131 X |
| 4,075,458 | 2/1978 | Moyer | 439/131 X |
| 4,467,263 | 8/1984 | Conforti et al. | 439/929 X |
| 4,697,070 | 9/1987 | Kai | 439/131 X |

FOREIGN PATENT DOCUMENTS 1364711 5/1964 France .

*Primary Examiner*—Khiem Nguyen
*Attorney, Agent, or Firm*—Bo-In Lin

[57] ABSTRACT

The present invention comprises an integrated electric connector for connecting an electrical circuit to a power supply. The integrated electric connector comprises an insulating and enclosure means for enclosing and insulating the electric circuit. The electric connector further includes a foldable connection and attachment means for securely attaching to the insulating and enclosure means and for making electrical connection between the electric circuit and the power supply. And, the foldable connection and attachment means further includes a pair of external power connection plugs each being pivotally connected via a rivet means to a corresponding internal circuit connection means wherein the external power connection plug being pivotally foldable while maintaining constant electric connection between the external power connection plugs and the internal circuit connection means.

6 Claims, 3 Drawing Sheets

INTEGRATED FOLDABLE ELECTRIC PLUG CONNECTOR

BACKGROUND OF THE INVENTION

1. Field of the Invention

This invention relates generally to an electric plug connector. More particularly, this invention relates to a flexibly foldable electric plug connector for connecting to associated internal circuits wherein the electric plug connector is configured to improve the foldable connection of the plug thus reducing the space occupied and providing improved electric connection and strengthening construction whereby the electric plug connector connected to the associated internal circuits is suitable for continuous portable operation.

2. Description of the Prior Art

Current trend in the miniaturization of electronic devices and computers imposes higher demand on the form factors of the electric power connectors, particularly those of the plug-in types of connectors. The demands on form factors include the requirements that these types of connectors be made such that they have smaller size, less weight, convenient for shipment. More importantly, they must be durable in order to sustain long term portable operation on a continuous basis.

These demands cause special challenges to the design of the plug-in type of connectors due to the fact that the plugs for making electrical connection of this kind of connectors are vulnerable as the plugging legs usually extend outside of the body of the connectors and can be easily damaged without protection. This could cause serious concerns for the operation of the portable computers. A specific need in the operation of a portable notebook computer is to carry along a rechargeable battery package which generally comprises a plurality of rechargeable batteries contained in an enclosure box which has the charging circuits and a plug-in connector to plug into the electrical outlet for recharging. It is highly desirable for the battery package to be small, light, and easy to be conveniently portable. On the other hand, this package has to be very durable and sturdy and the electric contacts between the charging circuits and the plug-in connector have to be reliably maintained so that the package is suitable for the portable operation with high degree of reliability.

Many of the conventional electrical connectors including some of these plugs for the battery chargers are made with a structure such that they are foldable. This types of battery charger generally is constructed with the shape of a box containing inside the box the circuits for charging the batteries. The battery charger also has a pair of outwardly extended electrical plugging legs for connecting to an external power supply. When the electrical connector is plugged into an external power supply, an electrical connection is established with an internal contact-unit through which the electrical power is provided to the internal circuits.

One example of these chargers is Sony's battery charger Model BC-3K4 which has a side-way foldable electrical plug as shown in FIG. 1 as a battery charger 10. The battery charger 10 comprises charging circuits 12 for charging the re-chargeable batteries (not shown) which are contained in a containing box 15. The containing box 15 has a concave confinement 18 containing a foldable electric plug unit 20 which includes a pair of outwardly extending plugging legs 22 for plugging into the external power supply (not shown). The extending plugging legs 22 are attached to a foldable fixture 24 which is attached to the bottom of the concave confinement 18 by use of a pivotally rotatable attachment spring 28. The foldable electric plug unit 20 can thus pivot the attachment spring 28 and the outwardly extended electric plugging legs 22 can be rotated along the A—A' direction to be either folded into the concave confinement 18 when not in use or can be deployed by rotating toward the A'—A direction such that the plugging legs 22 are fully outwardly extended to be plugged into an external power supply (not shown).

In order to establish an electric contact between the extending plugging legs 22 and the internal circuits 12, the electric plug unit 20 also has a pair of internally extending plates 30. Each of the internally extending plates 30 is electrically connected to a corresponding outwardly extending electric plug 22 and mechanically attached to the foldable fixture 24. The internally extending plates 30 can therefore rotate along the A—A' direction together with the outwardly extending plugging legs 22 and the foldable fixture 24 pivot the attachment spring 28. When the foldable fixture 24 is rotated toward the A'—A direction to unfold the outwardly extending plug 22, the internally extending plates 30 is moved to engage a pair of spring contact plates 32. The internally extending plates 30 first push the pair of the contact spring plates 32 which then spring back to tightly engage the internally extending plates 30 to establish an electric contact.

In order to assure that a good electric contact is established, the spring contact plates 32 assert a spring force which pushes the spring contact plates 32 to tightly engage the internally extending plates 30. The spring contact plates 32 thus provide a mechanical means for establishing and maintaining good electric contact. Sony's BC-3K4 battery charger however suffers several disadvantages. First, the spring contact plates may gradually lose its spring force under prolong use which may cause it to suffer mechanical fatigue. The loss of the spring force may further cause inadequate contact causing excessive heat and electric sparks to be generated at the contact point between the internally extending contact plate 30 and the spring contact plates 32. The electric contact may be further degraded because the heat and the sparks often cause the surfaces of these contact plates to oxidize thus forming an oxidation film on these surfaces which further prevent a good electric contact to be established.

Secondly, since the internally extending plates 30 have to rotate inside the containing box 15 when the foldable fixture 24 pivots the attachment spring 28 when the outwardly extending electric plugging legs 22 are to be folded or unfolded, more space has to be used for the movement inside the containing box 15. Even though the space required to allow the internally extending contact plates 30 to rotate may seem small and insignificant, for the purpose of being portable with a notebook or palm-top computers, every inch saved may often become important in order to reduce the weight and size of these battery chargers. Sony's design may therefore impose a limitation preventing the battery charger to become further miniaturized due to this requirement of extra space for internal rotation of the internally extending contact plates 30.

Thirdly, Sony's battery chargers and many other foldable electric plugs of similar designs have another major difficulty in the mechanical design. The foldable fixtures usually have weak mechanical structure for attaching to either the containing box or other structures of the electric plug connector. The requirement that the plugs have to foldable often imposes a limitation on the attachment mechanism which must be pivotally moveable. The attachment mechanism is frequently being designed as a single point or to the most single axial, two-point attachment mechanism. The weak attachment structure may cause the foldable unit to be less reliable and may also affect the establishment or maintenance of a good electric contact.

Therefore, there is still a need in the art of design and manufacture of electric plug connector to provide a foldable electric plug connector which is durable, compact and capable of reliably establishing and maintaining good electric contact.

SUMMARY OF THE PRESENT INVENTION

It is therefore an object of the present invention to provide an electrical connection apparatus and method to overcome the aforementioned difficulties encountered in the prior art.

Specifically, it is an object of the present invention to provide an integrated foldable electrical connector which is flexibly foldable and has integrated mechanical structure so that it is convenient and also durable for long term and continuous shipment and portable operation.

Another object of the present invention is to provide an integrated foldable electrical connector wherein the outwardly extending plugging legs are integrated with the internally extending contact means as one mechanical structure such that good electric contact is constantly maintained.

Another object of the present invention is to provide an integrated foldable electrical connector wherein the outwardly extending plugging legs are integrated with the internally extending contact means which can be maintained securely attached to the structure of the connector without being required to move so that the internal space of the connector can be saved.

Another object of the present invention is to provide an integrated foldable electrical connector which can be easily manufactured with simple assembly operation thus the cost of manufacture can be reduced.

Briefly, in a preferred embodiment, the present invention comprises an integrated electric connector for connecting an electrical circuit to a power supply. The integrated electric connector comprises an insulating and enclosure means for enclosing and insulating the electric circuit. The electric connector further includes a foldable connection and attachment means for securely attaching to the insulating and enclosure means and for making electrical connection between the electric circuit and the power supply. And, the foldable connection and attachment means further includes a pair of external power connection plugs each being pivotally connected via a rivet means to a corresponding internal circuit connection means wherein the external power connection plug being pivotally foldable while maintaining constant electric connection between the external power connection plugs and the internal circuit connection means.

It is an advantage of the present invention that it provides an integrated foldable electrical connector which is flexibly foldable and has integrated mechanical structure so that it is convenient and also durable for long term and continuous shipment and portable operations.

Another advantage of the present invention is that it provides an integrated foldable electrical connector wherein the outwardly extending plugging legs are integrated with the internally extending contact means as one mechanical structure such that good electric contact is constantly maintained.

Another advantage of the present invention is that it provides an integrated foldable electrical connector wherein the outwardly extending plugging legs are integrated with the internally extending contact means which can be maintained securely attached to the structure of the connector without being required to move so that the internal space of the connector can be saved.

Another advantage of the present invention is that it provides an integrated foldable electrical connector which can be easily manufactured with simple assembly operation thus the cost of manufacture can be reduced.

These and other objects and advantages of the present invention will no doubt become obvious to those of ordinary skill in the art after having read the following detailed description of the preferred embodiment which is illustrated in the various drawing FIGURES.

DETAILED DESCRIPTION OF THE PREFERRED EMBODIMENT

Figure 1:
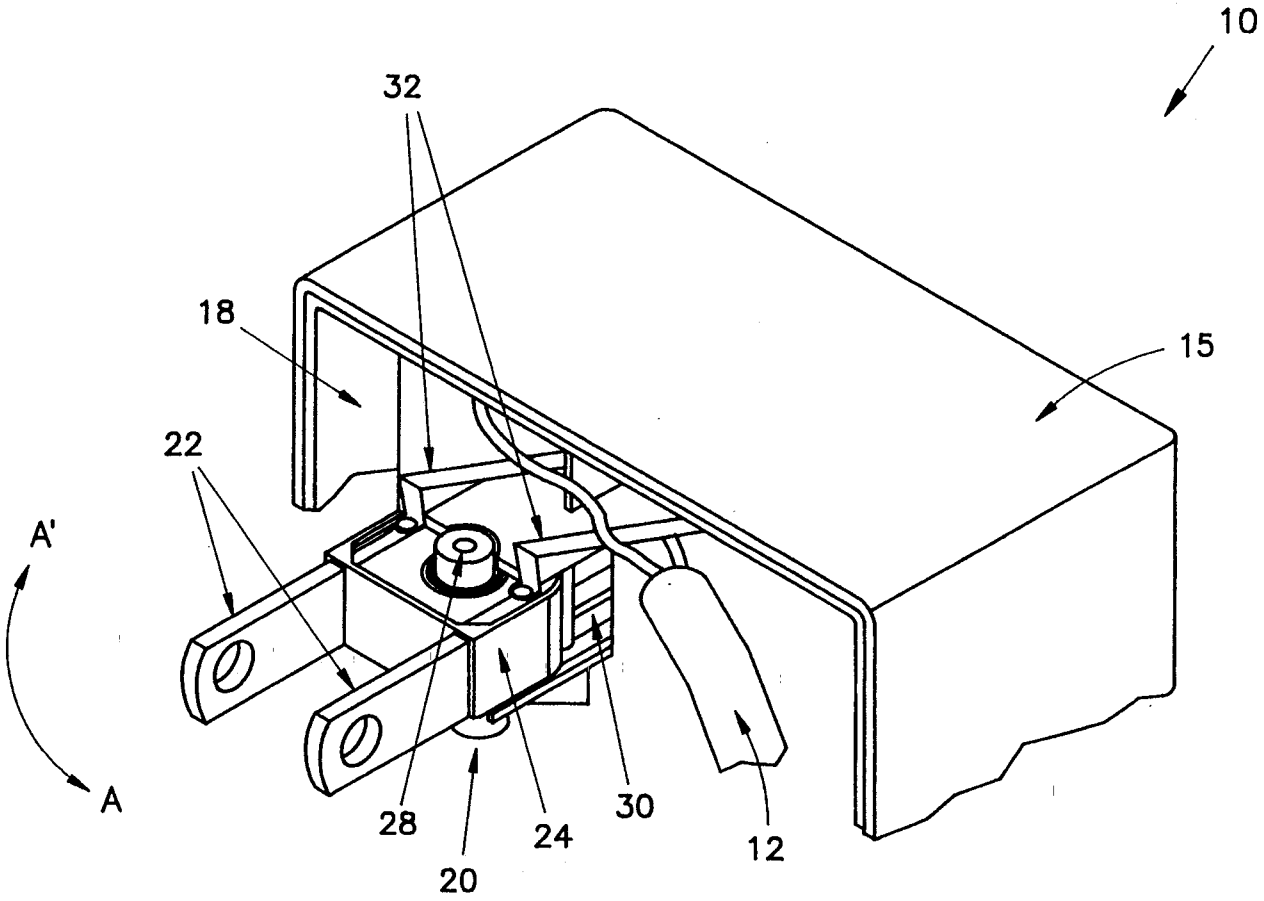
Figure 1 (Prior Art)
FIG. 1 is a partial perspective view of a prior art foldable electric plug connector.
Figure 2:
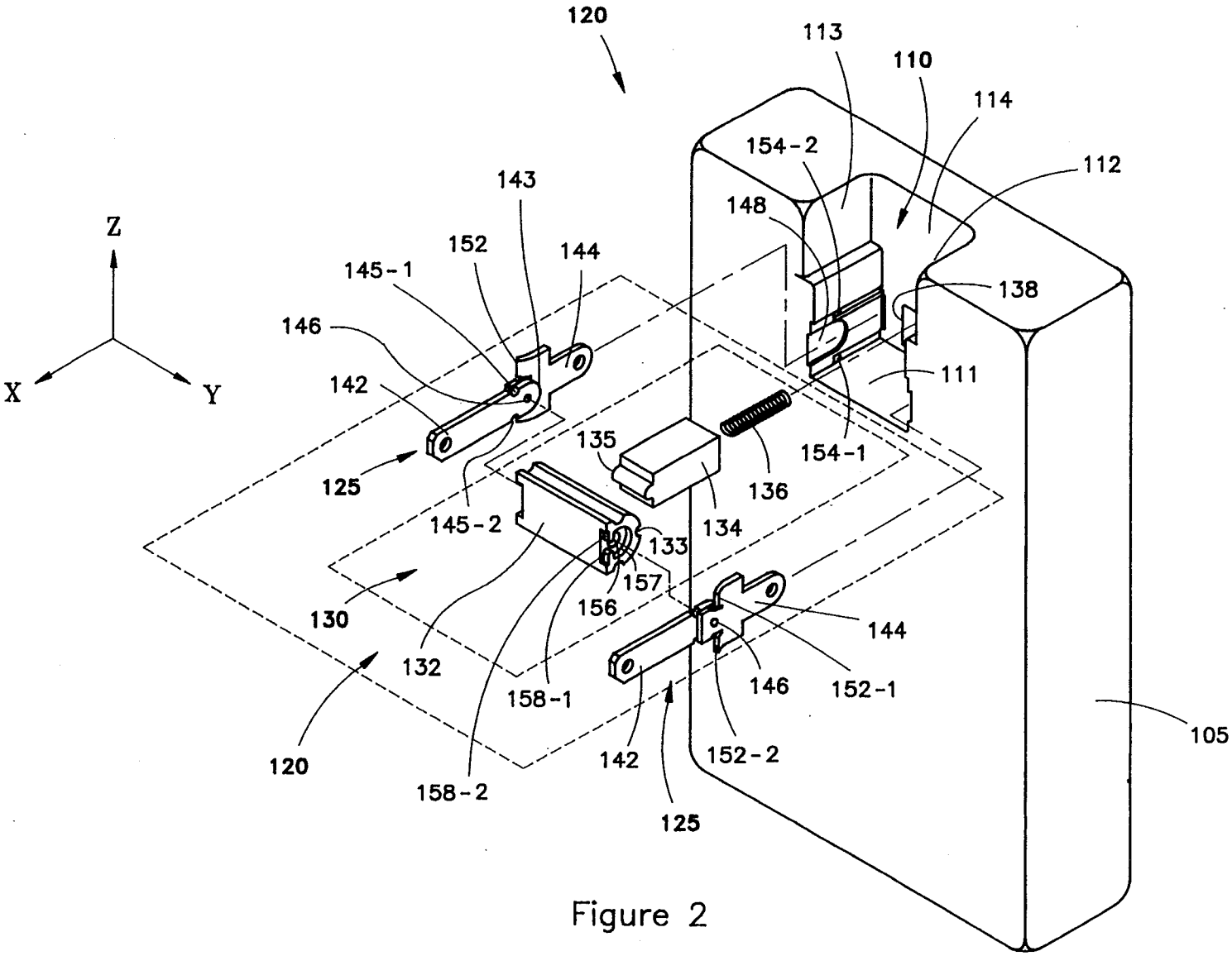
FIG. 2 is a partial perspective view of an integrated foldable electric plug connector according to the present invention.

FIG. 2 shows a perspective view of a preferred embodiment comprising an electrical connector 100 before the connector 100 is assembled, according to the present invention. The electrical connector 100 comprises an insulating enclosure means 105 which is composed of electrical insulating material substantially in the shape of a rectangular box with a dimension of approximately eighty-nine centimeters in height, i.e. along Z-direction, fifty-nine centimeters in width, i.e., along Y-direction, and fourteen centimeters in depth, i.e., along X-direction. The insulating enclosure means includes a substantially rectangular-shaped concave storage confinement 110 near the top edge of the enclosure means 105. The concave storage confinement 110 forms an open space surrounded by a bottom wall 111, a right wall 112, a left wall 113, and a back wall 114. The electrical connector 100 further includes a foldable connection and attachment means 120 for connecting to an electrical power supply (not shown) and for securely attaching onto the insulating enclosure means 105. Whereas the foldable connection and attachment means 120 is disposed in the concave storage confinement 110 and can be flexibly folded and stored in the storage confinement 110. When the foldable connecting and attachment means 120 is not used for connecting to the electric power supply, it can be folded into the storage confinement 110 and fully surrounded and protected by the bottom wall 111, the right wall 112, the left wall 113, and the back wall 114.

Figure 3:
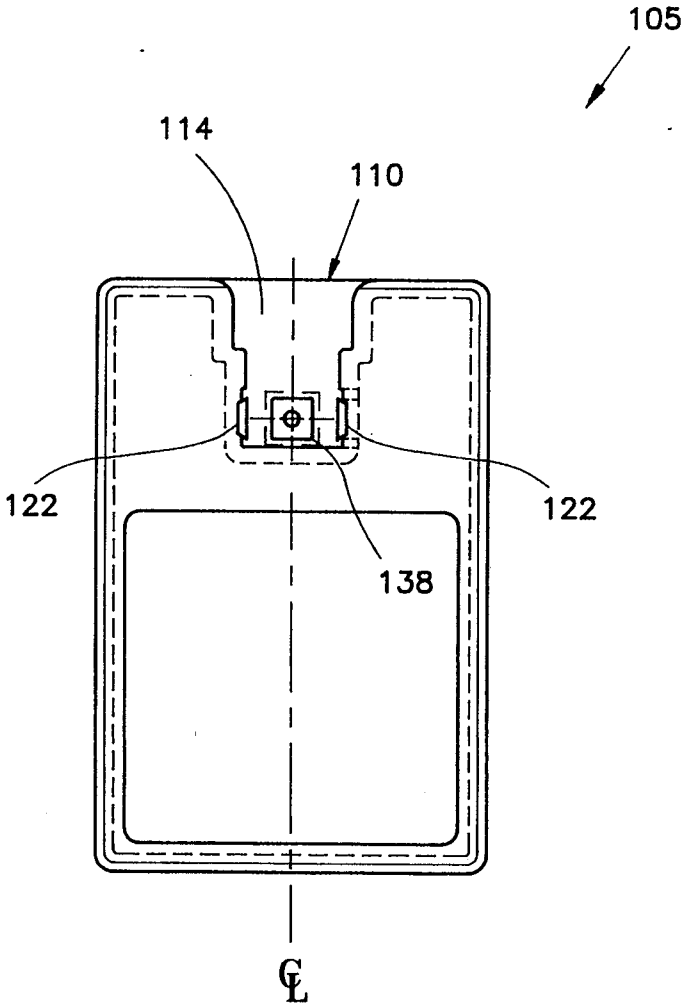
FIG. 3 is a front view of the insulating enclosure means of the integrated foldable electric plug connector of FIG. 2.

Referring to FIG. 3 wherein a front view of the insulating enclosure means 105 is shown. The storage confinement 110 further has two electrical-connection openings 122 disposed on the back wall 114 which allow the connection and attachment means 120 to penetrate through the electrical-connection openings 122 for making electrical connection with other electrical circuits (not shown) contained in rectangular box, i.e., the insulating enclosure means 105. For a particular embodiment, the circuits contained in the enclosure means 105 may be charging circuits and rechargeable batteries connected to the charging circuits contained therein.

Referring to FIG. 2 again, the foldable connection and attachment means 120 further includes a pair of foldable electrical connection means 125 for connecting to power supply. The foldable connection and attachment means 120 further includes a rotatable attachment means 130 which comprises a semi-circular rotatable transverse rod 132, an engaging block 134 and a asserting spring 136. The concave storage confinement 110 further has a pushing-in recess 138 (see FIG. 3) substantially in the shape of an inwardly concave box disposed on the surface of back wall 114 of the storage confinement 110. The pushing-in recess 138 forms a hollowed volume with sufficient space to receive the asserting spring means 136 and the engaging block 134 when the rotatable transverse rod 132 push the engaging block 134 and the asserting spring means 136 into the pushing-in recess 138. The rotatable transverse rod 132 further has a plurality of recessed grooves 133 and the engaging block 134 further has a protruding engaging ridges 135 to fit into the recessed grooves 133.

The foldable electrical connection means 125 includes a pair of external power connection plugs 142 wherein each connection plug 142 is connected to a corresponding internal circuit connection means 144 through a rivet means 146 so that the connection plug 142 is rotatable relative to the internal circuit connection means 144 pivots the rivet means 146. The external power connection plug 142 has a semi-circular pushing-in end 143 near the rivet means 146 and along the longitudinal direction right next to the semicircular pushing-in end 143, the external power connection plug 142 has two locking indentations 145-1 and 145-2 on either edge of the external power connection plug 142. On both ends of the rotatable transverse rod 132 there is a concave rivet reception 156 to receive the rivet means 146, a concave semi-circular end-rest 157 to receive the semi-circular pushing-in end 143, and two locking ridges 158-1 and 158-2 to plug in the locking indentations 145-1 and 145-2.

To assemble the electrical connector 100, the foldable electrical connection means 125 including this pair of inter-connected external power connection plug 142 is first engaged to the rotatable transverse rod 132 on both ends. Then the external power connection plug 142 engaged to the rotatable transverse rod 132 together with the internal circuit connection means 144 and the rivets means 146, are pushed along the right wall 112 and the left wall 113. The right wall 112 and the left wall 113 each has a sliding recess 148 to allow the internal circuit connecting means 144 and the connecting rivet means 146 to slide in along the side walls 112 and 113. When the internal circuit connecting means 144 penetrates through the electrical connection openings 122, the semicircular pushing-in end 143 of the external power connection plugs 142 are engaged, one on each side against the left and right walls of the storage confinement 110, tightly to a concave semi-circular end-rest 157 thus pushing the rotatable transverse rod 132 which in turn pushing the engaging block 134 and the asserting spring 136 into the pushing-in recess 138.

The internal circuit connection means 144 further has an engaging locking means 152 in the shape of two small locking tongues, i.e., 152-1 and 152-2 on the top and bottom respectively, extended outwardly from and disposed near the front end of the body of the internal circuit connection means 144. The right wall 112 and the left wall 113 each further has a engaged-locking means 154 disposed near the back wall 114 in the shape of two elongated openings allowing two of the locking tongues to extend out from the left wall 113 and the right wall 112. When the foldable electrical connection and attachment means 120 is pushed into the concave storage confinement means 110 the asserting spring 136 asserts a force pushing the engaging block and rotatable transverse rod out. The engaging locking means 152 which comprises two outwardly extended locking tongues, i.e., 152-1 and 152-2, extending out from the two corresponding openings 154-1 and 154-2 of the engaged locking means 154. The two locking tongues 152-1 and 152-2 are pushed out by the asserting spring 136 to engage securely against the front edges of two openings 154-1 and 154-2 of the engaged locking means 154 thus lock the electrical connection and attachment means 120 securely to the insulating enclosure means 105 in the concave storage confinement 110.

With the external power connection plugs 142 pivotally connected via the rivet means 146 as one integrated electric connection, and the internal connection means 144 is securely locked to the internal circuit connection means 144, the external power connection plugs 142 have the flexibility to pivot along the rivet means 146. Meanwhile, the external power connection plug 142 is tightly engaged to the rotatable transverse rod 132 near the rivet means 146, on both ends of the rotatable transverse rod 132, via the coupling of (a) the rivet means 146 to the concave rivet reception 156, (b) the semi-circular pushing-in end 143 to the semi-circular end rest 157, and (c) the two locking indentations 145-1 and 145-2 to the two locking ridges 158-1 and 158-2. Because of these tight couplings, when the external power connection plugs 142 are pivotally rotated around the rivet means 146, the rotatable transverse rod 132 will also rotate together. Since the rotatable transverse rod 132 and the engaging block 134 are pushed by the asserting spring means 136 and thus tightly engaging to each other, the rotation of the transverse rod 132 together with the external power connection means 142 is stabilized by the engaging force asserted by the asserting spring means 138. Additionally, the recessed grooves 133 on the transverse rod 132 and the protruding engaging ridges 135 on the engaging block 134 further provide stability for the external power connection plugs 142 to stay at certain fixed angles. Thus, when the connection plugs 142 are folded in completely or when the connection means is rotated to a perpendicular position relative the enclosure means 105 to be plugged into a power supply, the external power connection plugs 142 will remain with higher degree of stability in these position.

When the external power connection plugs 142 pivot the rivet means 146 in performing the folding and unfolding operations, the internal circuit connection means 144 remains fixed in position without movements and securely locked to the insulating enclosure means 105. Since the internal circuit connection means 144 are not required to move in the folding and unfolding operations, it is not required to provide space inside the insulating enclosure means 105 to allow for such movement. Space saving is achieved through the structure provided in the present invention. Also, since the external power connection plugs 142 are connected to the internal circuit connection means 144 through the rivet means 146, there is no on-off motions during its actions of folding and unfolding operations. A good electric contact is always maintained. The potential problems of poor electric contact as often encountered in the prior art are thus eliminated.

The structure of the electrical connector 100 is strengthened by (1) the coupling between the external power connection plugs 142 to the rotatable transverse rod 132, (2) the lock formed between the internal circuit connection means 144 and the left wall 112 and the right wall 113 via the engaging locking means 152-1 and 152-2 and the engaged locking means 154, i.e., the two openings 154-1 and 154-2 on these two side walls, and (3) the tight engagement between the engaging block 134 against the rotatable transverse rod 132 as pushed by the asserting spring 136 and via the couplings between the recessed grooves 133 on the rotatable transverse rod 132 and the corresponding protruding engaging means 135 on the engaging block 134.

Additionally, by utilizing the aforementioned structure, the foldable electrical connector 100 can be easily assembled either manually or via automated manufacture processes. The manufacturing cost is reduced by the use of this simple design. Additionally, the structure is very durable and suitable for long term portable operation on a continuous basis. The external power connection plugs 142 are securely structured and well protected when folded into the storage confinement 110 in shipment. This foldable electrical connector is particular useful for a portable packages containing rechargeable batteries with charging circuits which are often carried around in a suite case and frequently being plugged into an electric outlet for recharging operations.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

I claim:

1. An integrated electric connector for connecting an electrical circuit to a power supply comprising:

an insulating and enclosure means for enclosing and insulating said electric circuit;

a foldable connection and attachment means for securely attaching to said insulating and enclosure means and for making electrical connection between said electric circuit and said power supply;

said foldable connection and attachment means further including a pair of external power connection plugs each being pivotally connected via a rivet means to a corresponding internal circuit connection means wherein said external power connection plug being pivotally foldable while maintaining constant electric connection between said external power connection plugs and said internal circuit connection means;

said internal circuit connection means is securely attached to said insulating and enclosure means without requiring movements during said pivotal foldable operations of said external power connection plugs;

said insulating and enclosure means further includes a concave storage confinement for confining and storing said external power connection plugs when said external power connection plugs are folded;

said foldable connection and attachment means further includes a locking and stabilizing means for securely locking said foldable connection and attachment means;

said locking and stabilizing means further includes a rotatable transverse rod, an engaging block and an asserting spring;

said rotatable transverse rod transversally engages near said rivet means between and pivotally rotate together with said pair of external power connection plugs;

said engaging block engages said rotatable transverse rod for stabilizing said pivot rotation of said rotatable transverse rod and said external power connection plugs; and said asserting spring engages said engaging block for asserting a force pushing said engaging block to tightly engage said rotatable transverse rod;

said rotatable transverse rod includes a semi-circular surface along a longitudinal direction of said rod for rotatably engaging said engaging block;

said rotatable transverse rod further includes two ends each includes a coupling and locking means for coupling and locking to one of said pair of external power connection plugs;

said semi-circular surface of said rotatable transverse rod further has a plurality of engaging grooves and said engaging block further has an engaging ridge to fit said engaging grooves whereby said rotatable transverse rod with said pair of external power connection plugs can be stably maintained at fix positions when said engaging ridge engages one of said engaging grooves;

each of said pair of internal circuit connection means further includes an engaging locking means and said concave storage confinement further include a corresponding engaged locking means; and each of said engaging locking means is a pair of outwardly extending locking tongues and each of said engaged locking means is a corresponding pair openings on said concave storage confinement wherein each of said locking tongues extends outwardly from said opening and each of said locking tongues is further pushed by said asserting spring, said engaging block and said rotatable transverse rod to tightly engage and securely locked to said concave storage confinement.

2. An integrated electrical connector for connecting an electrical circuit to a power supply comprising:

an insulating and enclosure means for enclosing and insulating said electric circuit;

a foldable connection and attachment means for securely attaching to said insulating and enclosure means and for making electrical connection between said electric circuit and said power supply;

said foldable connection and attachment means further including a pair of external power connection plugs each being pivotally connected via a rivet means to a corresponding internal circuit connection means wherein said external power connection plug being pivotally foldable while maintaining constant electric connection between said external power connection plugs and said internal circuit connection means;

said internal circuit connection means is securely attached to said insulating and enclosure means without requiring movements during said pivotal foldable operations of said external power connection plugs;

said insulating and enclosure means includes a concave storage confinement for confining and storing said external power connection plugs when said external power connection plugs are folded;

said foldable connection and attachment means further includes a locking and stabilizing means for securely locking said foldable connection and attachment means;

said locking and stabilizing means further includes a rotatable transverse rod, an engaging block and an asserting spring;

said rotatable transverse rod transversally engages near said rivet means between and pivotally rotate together with said pair of external power connection plugs;

said engaging block engages said rotatable transverse rod for stabilizing said pivot rotation of said rotatable transverse rod and said external power connection plugs; and said asserting spring engages said engaging block for asserting a force pushing said engaging block to tightly engage said rotatable transverse rod.

3. The electrical connector of claim 2 wherein:

said rotatable transverse rod includes a semi-circular surface along a longitudinal direction of said rod for rotatably engaging said engaging block; and said rotatable transverse rod further includes two ends each includes a coupling and locking means for coupling and locking to one of said pair of external power connection plugs.

4. The electrical connector of claim 3 wherein:

said semi-circular surface of said rotatable transverse rod further has a plurality of engaging grooves and said engaging block further has an engaging ridge to fit said engaging grooves whereby said rotatable transverse rod with said pair of external power connection plugs can be stably maintained at fix positions when said engaging ridge engages one of said engaging grooves.

5. The electrical connector of claim 4 wherein:

each of said pair of internal circuit connection means further includes an engaging locking means and said concave storage confinement further include a corresponding engaged locking means wherein each of said engaging locking means is securely locked to said engaged locking means whereby each of said internal circuit connection means is securely attached to said concave storage confinement.

6. The electrical connector of claim 5 wherein:

each of said engaging locking means is a pair of outwardly extending locking tongues and each of said engaged locking means is a corresponding pair openings on said concave storage confinement wherein each of said locking tongues extends outwardly from said opening and each of said locking tongues is further pushed by said asserting spring, said engaging block and said rotatable transverse rod to tightly engage and securely locked to said concave storage confinement.

* * * * *